United States Patent [19]

Mason

[11] 4,085,935

[45] Apr. 25, 1978

[54] AMUSEMENT DEVICE

[75] Inventor: John James Mason, Carlton, England

[73] Assignee: J. J. Mason Limited, Great Britain

[21] Appl. No.: 720,806

[22] Filed: Sep. 7, 1976

[30] Foreign Application Priority Data

Sep. 6, 1975 United Kingdom ..... 36773/75

[51] Int. Cl.[2] ..... A63B 69/36

[52] U.S. Cl. ..... 273/185 D; 206/315 R

[58] Field of Search ..... 273/186 R, 186 RA, 185 D, 273/192, 184 B, 185 R

[56] References Cited

U.S. PATENT DOCUMENTS

| | | | |
|---|---|---|---|
| 2,656,720 | 10/1953 | Sonnett | 273/185 D X |
| 3,738,660 | 6/1973 | Branz et al. | 273/185 D |

FOREIGN PATENT DOCUMENTS

| | | | |
|---|---|---|---|
| 1,122,531 | 8/1968 | United Kingdom | 273/185 D |

*Primary Examiner*—George J. Marlo
*Attorney, Agent, or Firm*—Miller & Prestia

[57] ABSTRACT

A device for practicing repetitive striking movements which is eminently suitable for golf putting practice. The device when for golf comprises a ball mounted on a platform in front of a slot and a hole. Accurate striking of the ball along the correct line 1 which is adjustable in width, gives a reward signal. An inaccurate stroke prevents the signal. The path of the ball is monitored electronically and the ball travels down into the hole to be held there a predetermined time before release and return to the striking position.

7 Claims, 6 Drawing Figures

AMUSEMENT DEVICE

This invention concerns devices which may be used for practising a repetitive movement, for example, golf putting technique.

Accordingly, the invention provides a device for practising repetitive striking movements, which comprises a support, a strikable object mounted for movement towards a displaced position and biassed into the striking position, means to detect movement of the object when struck, means to signal when that movement follows a predetermined path, the signalling means being controlled by the detecting means, means for holding the object in the displaced position remote from the striking position for a predetermined period after it has been struck and means to effect release of the object at the end of that predetermined period to allow it to be biassed back to the striking position.

The signalling means may produce a visual or audible signal but an audible signal is preferred.

Conveniently, the strikable object is a ball mounted on a movable arm. In one form of the invention, the support comprises a base and the ball is movable between a striking position disposed above the base and a displaced position disposed below the base so as to allow passage of a striking implement when "following through".

The strikable object is, as indicated above, biassed into the striking position. In one form of the invention, the object is carried on one end of an arm, the other end of which is secured to a spring, e.g. a coil spring, so as to extend axially with respect thereto. This arrangement can provide for movement of the object with an initial component in a horizontal plane in any direction. However, it will be appreciated that even an inaccurate stroke will normally propel the object in a generally forward direction and so it may not be essential for the object to be free to move forwardly in an arc of greater than, say, 180°. Even small arcs of initial horizontal movement will normally be sufficiently large to allow for accurate distinction between good and bad strokes, the limiting factor being that the arc of initial free movement must be greater than the arc of the predetermined accurate path.

The detector means may include a pair of detector contact elements arranged to detect when they are contacted by the strikable object or a member associated therewith, i.e. when the strikable object has deviated from the predetermined path. The positions of the detector contact elements may be adjustable (e.g. by hinging them at one end) so that a larger or smaller width of predetermined path can be set up. This enables a user to set the device to suit his ability.

Where the strikable object is mounted on a movable arm the detector contact elements may be arranged to detect contact of the arm.

The device may be designed for mains or battery operation. In one embodiment the device is designed for battery operation with the option of incorporation of a mains transformer. This transformer may, of course, be included in the original device or offered as an option "off the shelf".

The means to hold the strikable object in the displaced position may be electrical and/or mechanical. For battery operation it is preferred that the holding means be mechanical and that the release mechanism be triggered electrically.

Embodiments of the invention are now described with reference to the accompanying drawings in which.

Figure 1:
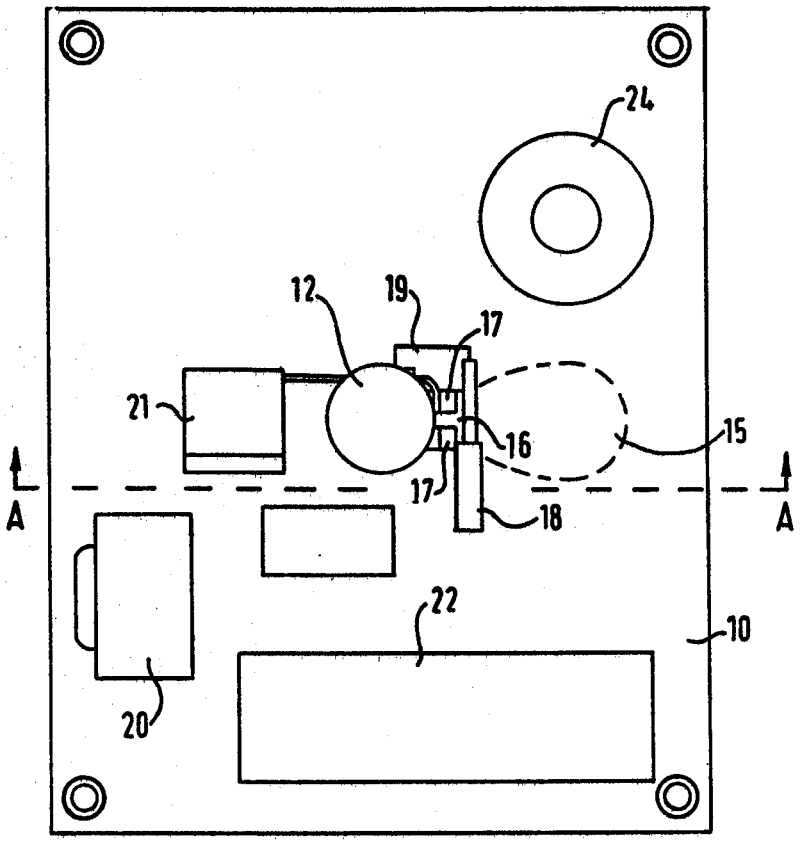
FIG. 1 is a schematic plan view of a mains-operated device according to the invention.
Figure 2:
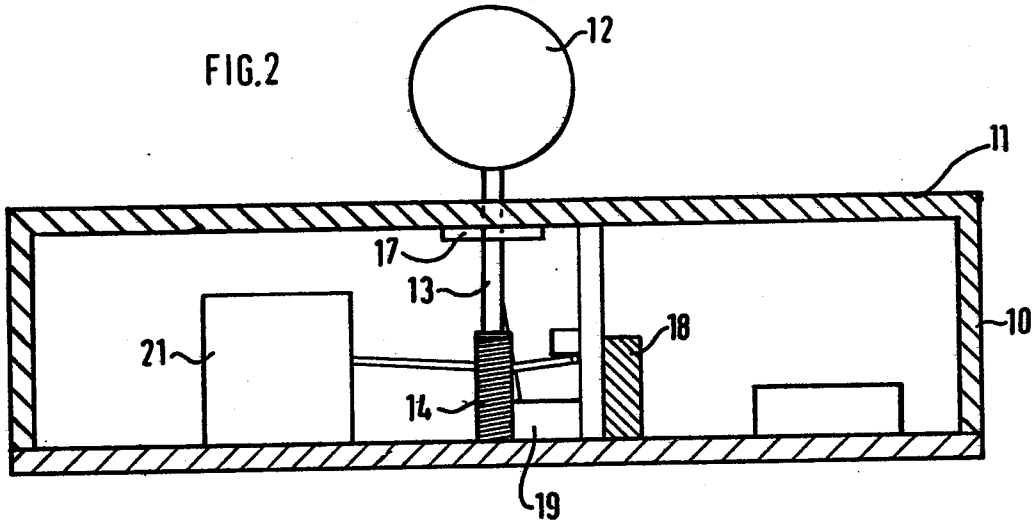
FIG. 2 is a cross-section of the device shown in FIG. 1.
Figure 3:
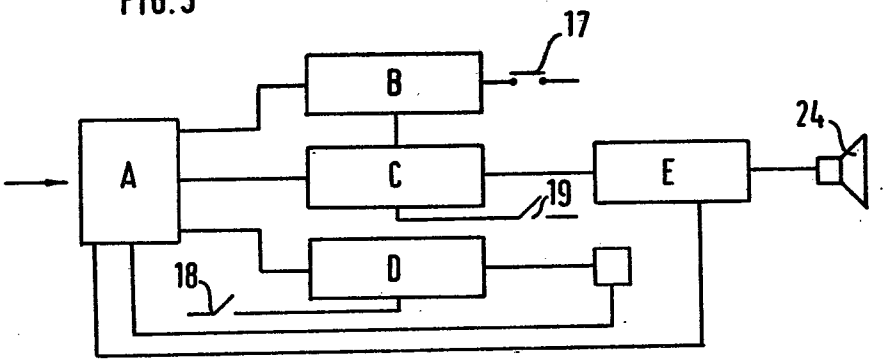
FIG. 3 is a block circuit diagram for the device of FIGS. 1 and 2.

The device of FIGS. 1, 2 and 3 comprises a base 10 in the form of a box having an upper surface 11 which may be provided with a suitable decorative surface such as a layer of green baise. A ball 12 which may be in the form of a golf ball is supported by an arm 13 carried by a coil spring 14 attached to the base 10 so that the ball is biassed to the position shown in the drawings but is movable when struck by a striking element such as a golf club.

As can be seen in FIG. 1 cover 11 is provided with an aperture 15 (depicted in dashed lines) for receiving the ball 12, the arm 13 moving along a slot 16 defined by metal contact plates 17. Microswitches 18 and 19 are positioned so as to be charged by the arm 13 when the ball moves towards the hole 15.

The apparatus shown is adapted to be mains operated and incorporates a transformer 20, a solenoid 21 and electronic circuitry, details of which are shown in FIG. 3.

A loudspeaker 24 is disposed in the top cover 11.

Referring to FIG. 3, A represents the power supply circuitry including transformer 20.

Three mono-stable circuits are employed, namely, inhibit mono-stable B, a buzzer mono-stable C and a relay mono-stable D. Buzzer mono-stable C is controlled by the microswitch 19 and is connected via an oscillator E to loudspeaker 24, whereas relay mono-stable D is controlled by microswitch 18.

The metal contacts 17 control inhibit mono-stable circuit B.

The operation of the device is as follows: when the ball is struck by the striking implement, the arm 13 passes along a path between the contacts 17. If it does this without making contact with the contact 17, the microswitch 19 is actuated by the arm 13 causing buzzer mono-stable C to actuate oscillator E and thereby provide an audible signal via loudspeaker 24.

When the ball 12 and thus arm 13 reaches its limit position arm 13 operates micro-switch 18 triggering the relay mono-stable D which holds the arm 13 and ball 12 below the level of the top cover 11 for predetermined time after which the relay releases and the ball 12 returns to its original position.

If after being struck the ball is "off-line" the arm 13 contacts one of the contacts 17 which operates inhibit mono-stable B which in turn prevents the buzzer mono-stable C from causing an audible signal to be produced.

In this manner it is possible for a person to practise striking the ball, e.g. as in putting, and when the ball has been struck along a correct line an audible signal will be heard.

Such apparatus therefore provides an extremely efficient way of producing correct putting.

Figure 4:
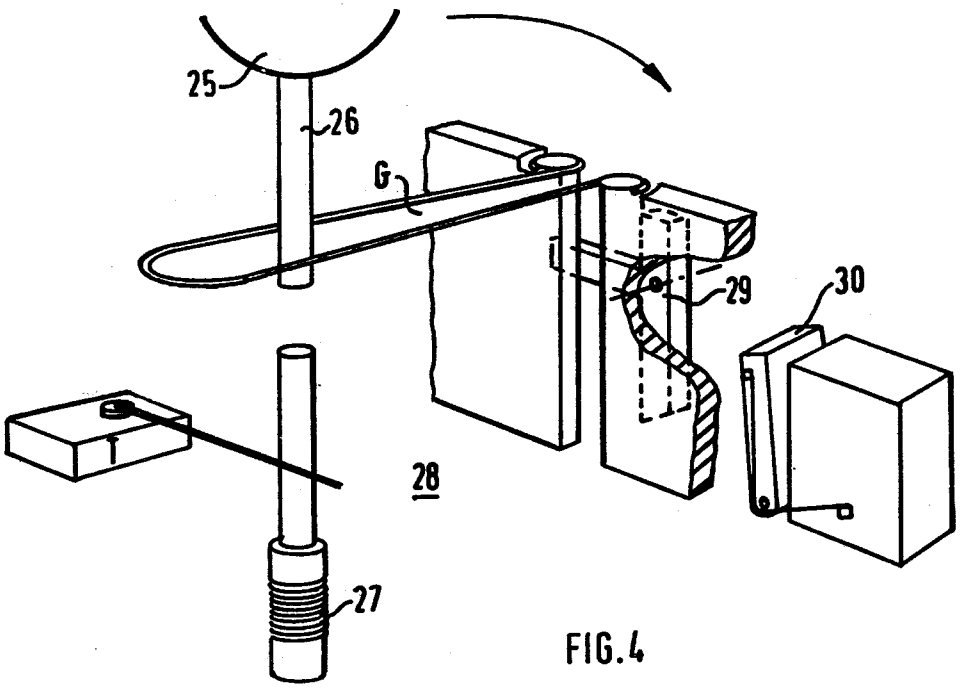
FIG. 4 is a diagrammatic illustration of an alternative form of device of the invention.

The device of FIG. 4 comprises a golf ball 25 mounted on a vertical arm 26. Arm 26 is mounted on a spring 27 fixed to the support structure 28. No other support is necessary to position the ball which is free to move with an initial component in any horizontal direction, but which will return automatically to the upright position when released by virtue of the action of the spring. When struck by a club the ball moves initially forwards and downwards into the platform through a hole in the top surface.

In order to move forward the arm 26 must pass through a small, tapered gap G, arranged so that the arm will not touch the sides if struck correctly for an eight-foot putt. A poor stroke results in the arm touching one of the tapered sides and being guided through the gap afterwards. By use of a metal ball arm and gap, electrical connection is made when the arm touches the tapered gap.

After passing through the gap the ball arm continues forward to strike an escapement piece 29, which in turn rotates and is latched by a spring-loaded solenoid arm 30, locking the escapement and the ball in this position. An electrical signal, obtained from a sensing switch T actuated by the ball arm 26, initiates the delatching of the solenoid and the ball returns to its initial striking position after a predetermined time.

Figure 5:
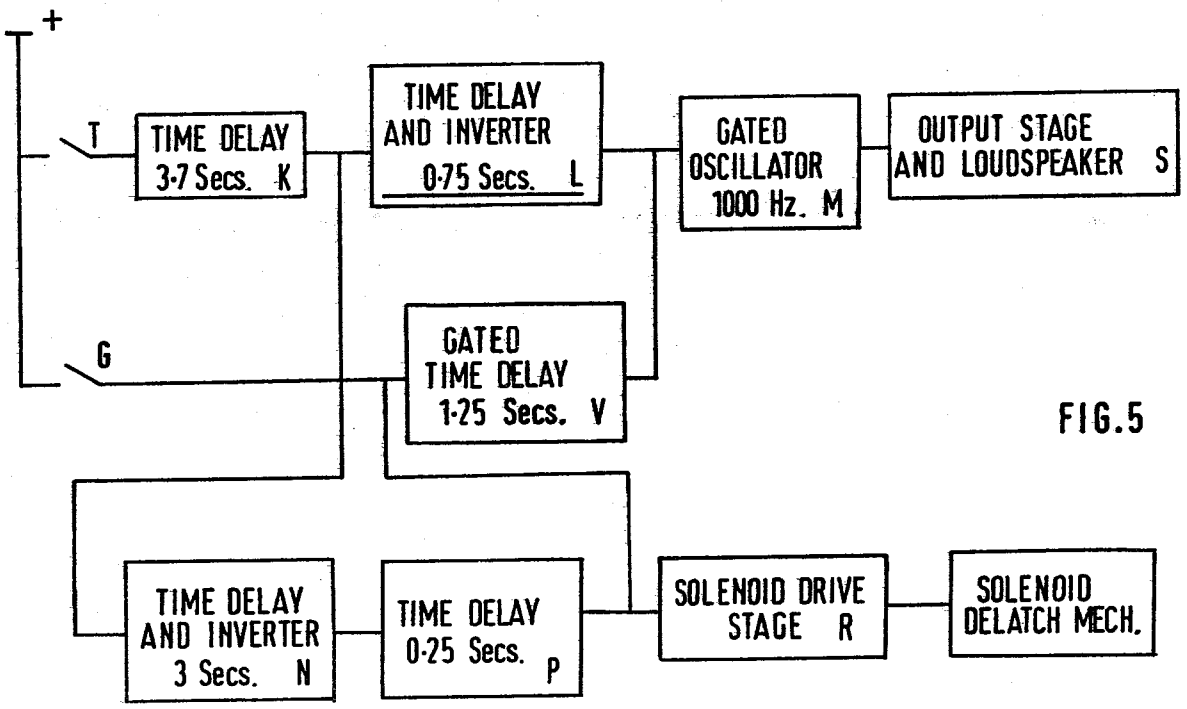
FIG. 5 is a block circuit diagram to show battery-operation of the device of FIG. 4.

The signal from the sensing switch T, which itself occurs no more than 25 msec. after striking the ball simultaneously initiates the time delays K, L and N for approximately 3.7 sec., 0.75 sec. and 3 sec. respectively (see FIG. 5). These delays cannot be reinitiated during the 3.7 sec. period set by delay K. For the period set by delay L, a gated oscillator M is run, this in turn driving an output stage and loudspeaker S. The effect is a $\frac{3}{4}$ sec. bleep at 1000 Hz. At the end of the period set by delay N, delays P and T are initiated and during this period set by delay P the solenoid R is actuated, releasing the ball. Delay V inhibits actuation of the oscillator as the ball returns preventing double reward bleeps. At the end of delay V the system is ready to accept the next shot. If the ball arm strikes the gap G the delay V is initiated inhibiting the reward bleep at the beginning of the stroke.

The device of FIGS. 4 and 5 is eminently suitable for battery operation.

Figure 6:
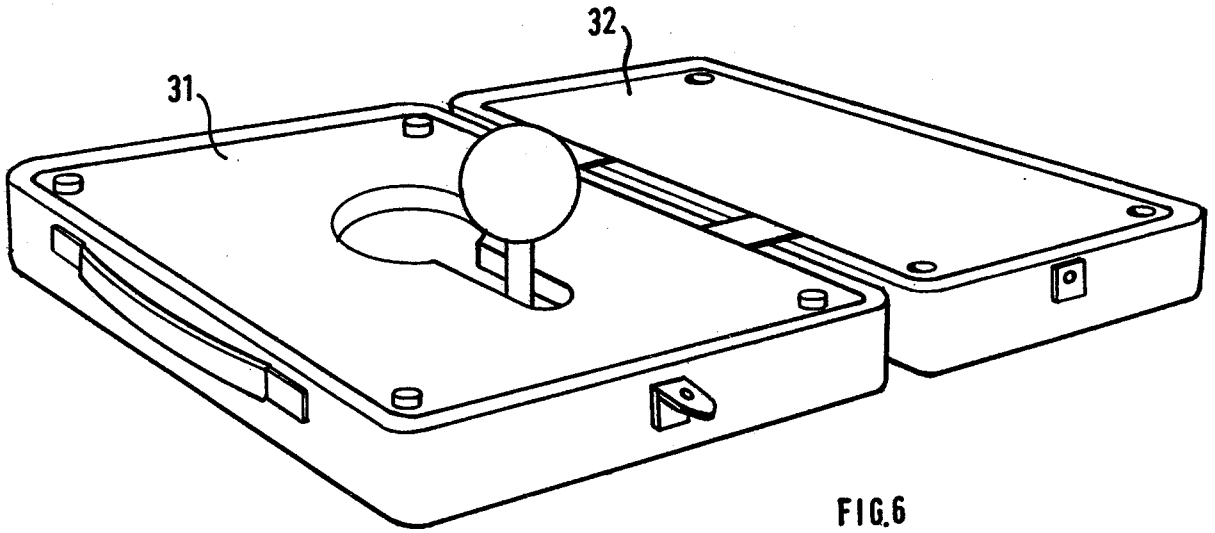
FIG. 6 is a perspective view showing one form of the device in readiness for use.

FIG. 6 shows a device ready for operation. The device consists of two raised platforms 31 and 32 equal in height and covered in an artificial surface to represent a putting green. Platform 31 houses the putting mechanism and platform 32 is an area upon which the player stands. Platform 32 may be attached to either side of platform 31 to facilitate left- or right-hand putting. The device is shown ready for use by a left-handed putter.

The platform can conveniently be of strong plastics mouldings and platform 32 acts as a lid which can be inverted from the position shown and placed on top of platform 31 when the device is not in use.

As an additional aid to the putter a marking device, e.g. a disc of standard cup or hole diameter, could be provided to act as a target at a suitable position in front of the putter.

It will be appreciated that various modifications can be made to the devices specifically described. For example, the time delays could be varied as desired but it has been found that a delay of the order of three seconds for N gives a satisfactory time for realistic, repeated putting strokes. The timing of the signal from sensing switch T could be varied but it has been found that the 'reward' signal is best given as soon after the good stroke as possible and that it is advantageous to the psychological reaction of the person practising to commence the reward signal within, say, 100 msecs. of the stroke.

The devices of the invention can be accurately calibrated for any specific length of putt, e.g. an eight-foot putt. Thus the detecting means will be set to sense and differentiate between those strokes that are sufficiently accurately 'on line' for the standard sized putting-green cup and those strokes that are too far off that line.

It will be appreciated that it is possible to incorporate in the device similar detecting means for the speed or strength of putt to determine whether or not the putt will travel the correct distance as well as on the correct line, but the devices specifically described above are intended to give useful repetitive practice for the line of the putt only.

Having now described our invention, what we claim is:

1. A device for practicing repetitive striking movements comprising a support, a strikable object mounted on said support for movement towards a displaced position and biassed into the striking position, adjustable detecting means mounted on said support to detect movement of the object when struck, said detecting means being adjustable to select a width of a predetermined path of travel of said object, means to signal when that movement follows said predetermined path, said signalling means being actuated by said detecting means, means for holding the object in the displaced position remote from the striking position for a predetermined period after it has been struck and means to effect release of the object at the end of that predetermined period to allow it to be biassed back to the striking position.

2. A device for practising repetitive striking movements comprising a support having a support surface, a simulated golf ball mounted on said support for movement towards a displaced position in which the ball is below the support surface and biassed into a striking position which is above the support surface; means for detecting the movement of the simulated golf ball between said striking and displaced positions, and means to generate a signal when the movement follows a predetermined path, which path is a simulation of a straight-line putt, said signal means being controlled by said detecting means, said detecting means including a pair of detector contact elements, one being positioned on each side of the limits of said predetermined path; means for holding the simulated golf ball in the displaced position below the support surface for a predetermined period after it has been struck and means to release said simulated golf ball at the end of said predetermined period whereby it returns to the striking position.

3. A device according to claim 2, in which the simulated golf ball is mounted on an arm and said arm is mounted on a spring extending axially with respect to said arm.

4. A device according to claim 3, in which the simulated golf ball is mounted on an arm and the detector elements detect contact of the arm.

5. A device according to claim 2, in which the means to hold the simulated golf ball in the displaced position is a mechanical locking means.

6. A device according to claim 5, in which the means to release the simulated golf ball is triggered electrically.

7. A device according to claim 2, in which the signal that the movement follows the desired predetermined path is given within 100 msecs. of an accurate stroke being made.

* * * * *